United States Patent [19]

Molinari

[11] 4,244,632

[45] Jan. 13, 1981

[54] CALLIGRAPHER'S PORTABLE DESK

[76] Inventor: Gloria G. Molinari, 128 Fulton St., Redwood City, Calif. 94061

[21] Appl. No.: 76,374

[22] Filed: Sep. 17, 1979

[51] Int. Cl.[3] ..... A45C 11/36

[52] U.S. Cl. ..... 312/231; 190/18 R; 190/42; 312/233

[58] Field of Search ..... 190/1, 11, 42, 18 R, 190/51; 206/214, 215, 224, 371; 312/231, 233; 224/151, 208, 224

[56] References Cited

U.S. PATENT DOCUMENTS

| | | | |
|---|---|---|---|
| 394,850 | 12/1888 | Glascock | 312/231 |
| 873,855 | 12/1907 | Goldin | 190/18 R UX |
| 1,013,231 | 1/1912 | Stearns | 190/18 R |
| 1,839,291 | 1/1932 | Barbour | 312/233 |
| 2,550,851 | 5/1951 | Nichols | 224/151 |
| 2,597,473 | 5/1952 | Green | 224/151 X |
| 3,123,190 | 3/1964 | Lifton | 190/42 X |
| 3,541,976 | 11/1970 | Rozas | 224/208 X |
| 3,983,976 | 10/1976 | Taylor | 190/42 |

FOREIGN PATENT DOCUMENTS

| | | | |
|---|---|---|---|
| 1286147 | 8/1972 | United Kingdom | 190/1 |

*Primary Examiner*—Donald F. Norton

[57] ABSTRACT

A sloped-top portable desk having a semi-soft covered writing surface, rounded on the front edge, which opens from the front having a hinge on the back wall where a carrying handle is located for portability; inside there are compartments fitted to the needs of the calligrapher, with the bottom of said desk having four feet, the two rear feet are adjustable to varying heights which change the writing slope. A stabilizing strap is included to be used when a table is not available to set said desk upon. A narrow bracket is provided to attach to the top writing surface which converts the desk into a podium; said bracket can also be used to convert the desk into a table easel. The total unit is a desk to be used with or without a table for the scribe to work upon. When the desk's top lid is closed, all the supplies are secured in their compartments for portability.

2 Claims, 5 Drawing Figures

CALLIGRAPHER'S PORTABLE DESK

BACKGROUND OF THE INVENTION

It has long been a conventional practice for calligraphers to execute the art of writing, illuminating and lettering, at home on a slanted table top. This portable desk affords the scribe to do his or her work anywhere using just a chair if necessary. The essential calligraphers supplied are arranged in compartments. When the desk is set on any table, the writing slope can be raised to help control the flow of ink. The calligrapher can achieve the angle preferred by adjusting the two rear feet of the desk. He or she has easy access to the desk's contents by lifting the front sloped writing surface, which is rounded to avoid creasing the paper. In addition, a table easel/podium bracket is supplied to provide two functions, it facilitates the use of the desk as a table easel, and as a podium.

DETAILED DESCRIPTION OF THE INVENTION

Figure 1:
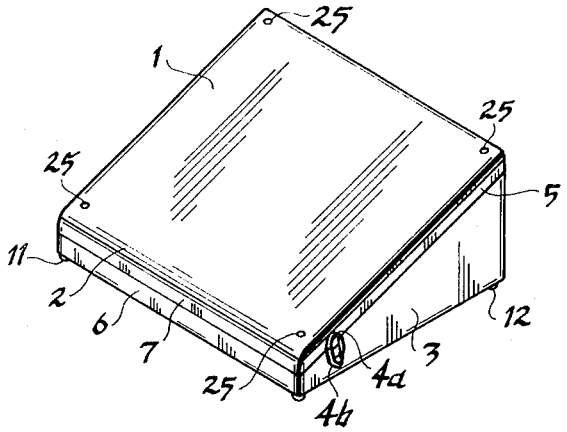
FIG. 1 is an isometric view of the slanted top writing surface, showing the rounded top front edge, and the right side of the desk with the looped fastener in a closed position.

A feature of this desk referring to the drawing FIG. 1, is the slope inherent in the top 1 which is covered with semi-soft material that accomodates pressure of the pen nibs while writing and illuminating. This slope from back to front, said front being rounded 2, which prevents creasing of the paper that might be pressed against said front edge, is connected therewith by tapered side walls 3 sloped in the same manner as the top, which support said top writing surface. These supportive side walls secure the top lid in its closed position by a looped fastener on each side wall. The top section of a fastener **4*a* fits onto the narrow side wall 5 of the lid 1 and the bottom section of a fastener 4*b* is secured onto the side wall 3. Said side walls are joined to the narrow front of the desk 6 which is directly below the narrow front 7 vertical portion of the top lid 1**.

Figure 2:
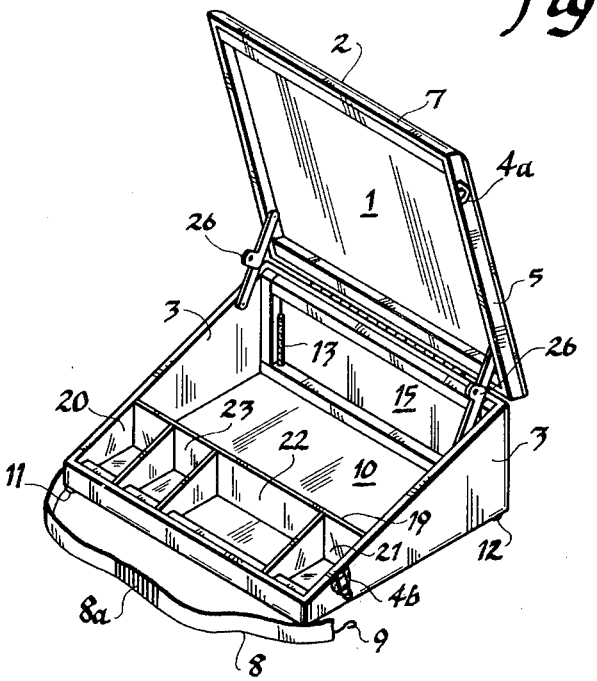
FIG. 2 is an isometric view of the desk with the top in an open position to reveal the various inner compartments. This view also shows the strap and the opened looped fastener.

Another feature of this desk is a back strap 8, FIG. 2, which has a small hook 9 on each end and an elastic portion in the center back **8*a* of the strap. This strap allows the calligrapher to work while sitting on a chair whenever a table is not available. One end of the strap is hooked 9 onto the hanging loop 4*b* of the open fastener on one side wall 3 and the other end of the strap 8 is brought around the back of the calligrapher waist high and attached to the other looped fastener 4*b* on the other side wall 3** of the desk.

Figure 4:
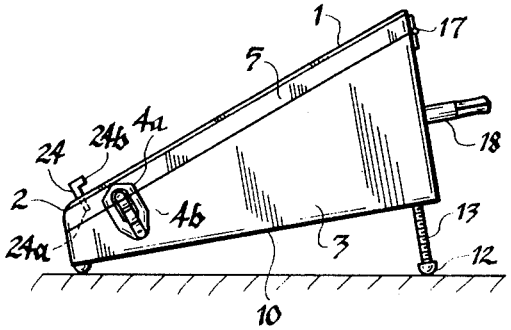
FIG. 4 is a side view showing the desk with the rear legs extended in one of its many adjustable positions. This view also shows the table easel/podium bracket in its podium position.

Another feature of this desk is that the side walls 3 are fitted onto a flat bottom piece 10, FIG. 2, which is in turn fitted with two short rubber feet 11 in the front and in the rear 12. The rear feet are adjustable FIG. 4, so as to give the top writing surface 1, FIG. 1, a variety of inclines to write upon FIG. 4. The rear feet 12 are attached to a threaded rod 13 which threads into the bottom 10 of the desk through a metal brace 14, FIG. 5, positioned flush with the bottom 10 and into the desk's storage compartment. Said threaded legs 13 can be marked at various desired lengths to correspond with the desired writing angles of the sloped top 1. When said legs 13 are not in use, they fit into the corner against the back wall 15 inside the desk FIG. 2.

Figure 5:
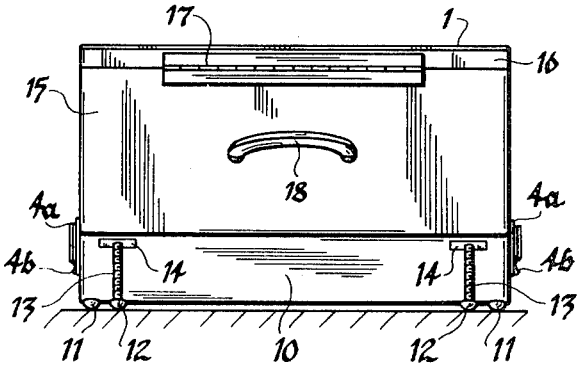
FIG. 5 is a rear view of the desk, showing the carrying handle, hinge, adjustable rear legs, and the brackets which secure said legs.

Another feature is that the back 16 of the top writing surface 1 FIG. 5 is attached to the back wall 15 by a hinge 17, which allows the top writing surface 1 to be opened from the front. Also on the back wall is located a carrying handle 18, which facilitates the desk's portability.

Still another feature is that the calligrapher's supplies are able to be arranged neatly inside the desk with the help of divided sections, FIG. 2. There is an extra long section for paper 19 formed by a narrow strip placed along the width of the desk 10. In the front sections of these inside compartments are two small plastic-lined sections, one on the left 20 and one on the right 21, which receive the ink containers. There is a larger section in the center 22 for pens and brushes and another smaller section next to it on the left to store pen nibs and wipers 23. When the top lid of the desk 1 is in its closed position the contents in the front sections are also closed into their compartments by said top lid 1 which secures the supplies when the desk is being carried.

Figure 3:
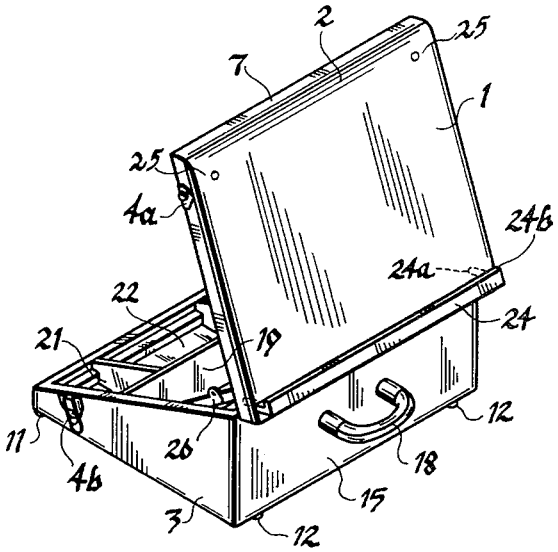
FIG. 3 is an isometric view of the back of the desk with the top lid in an open position showing the carrying handle and the table easel/podium bracket attached in its easel position.

Another feature is a table easel/podium bracket 24, FIG. 3, which fits onto the top writing surface 1. This bracket has a small peg **24*a* protruding from each side end and a lip across the front edge 24*b*. These pegs fit into a small hole 25 on either side of the top writing surface 1. This bracket is attached when the lid of the desk is lifted and held in its open position by two metal elbow hinges 26 which are attached to the inside of each side wall 3, FIG. 2. The desk with said table easel/podium bracket 24 attached FIG. 3, when placed on a table or stand can be used as a table easel for large poster work. Said bracket when placed in the front holes of the top writing surface 1** can be used as a podium.

What is claimed is:

1. A calligrapher's portable writing desk, to be used in conjunction with a table, comprised of a rectangular box with the front and rear walls having different heights which are also fitted on each end with tapered side walls slanting downward from rear to front, said side walls support a top lid with the side walls of said top lid and the side walls of the box being joined together with a fastener, said rear wall and a back portion of the top lid being joined together with a hinge which facilitates opening from the front, said rear wall also being affixed with a carrying handle for portability, a top writing surface being rounded on the front edge in addition to being covered with a smooth surface containing four small holes positioned one on each corner, said holes connectable with a narrow easel/podium bracket, said bracket having a peg protruding from each side end, with a lip along the front edge, said bracket being connectable horizontally into said holes in the front of the top surface with the lip side up to hold cards or paper upright against the top surface of the desk, said desk with said bracket attached in conjunction with a table being usable as a podium, said bracket being usuable on the two rear holes of the top surface when the lid of the desk is raised and held in a vertical position by an elbow bracket inside the side wall, said desk turned around with the back of the desk facing forward and the bracket attached to the said rear holes to provide for the desk to be used as an easel for larger lettering or posterboard brush work, a bottom surface having on each corner small rubber feet, the rear feet being attached to a threaded rod which is adjustable, said threaded rod varies the height of said feet by turning it through a metal bracket which is fitted flush with, and secured onto, the bottom of said desk, said rear feet when not in use, have their threaded rods positioned into the back inside corner of the desk.

2. A desk in accordance with claim 1 including inside compartments divided by a narrow strip standing vertically, parallel to said rear wall, each end of said strip secured to the box side wall, which provides a large long space to store paper, connected to said long strip vertically are three shorter strips, said strips being tapered on the top to conform to the sloping side walls of the box, with the front ends of said short strips being so positioned as to divide a front section into three small compartments and one large compartment, one strip is positioned near each side wall the width of an ink bottle away, so as to have an ink container compartment on the right and left of the front, another strip is positioned next to the left compartment leaving space for pen nibs and wipers, a longer compartment is left in the middle to store pens and brushes, the ink compartments being lined with a plastic material, said supplies are secured in their compartments when the lid of the desk is secured.

* * * * *